United States Patent [19]

Girard et al.

[11] Patent Number: 4,889,371

[45] Date of Patent: Dec. 26, 1989

[54] MOTORIZED CLOSING DEVICE, PARTICULARLY FOR AN AUTOMOTIVE-VEHICLE TRUNK

[75] Inventors: Joel Girard, Abbeville; Christian Wattebled, Sailly-Fibracourt, both of France

[73] Assignee: Vachette, Paris, France

[21] Appl. No.: 119,884

[22] Filed: Nov. 13, 1987

[30] Foreign Application Priority Data

Nov. 13, 1986 [FR] France ..... 86 15726

[51] Int. Cl.[4] ..... E05C 17/56

[52] U.S. Cl. ..... 292/201

[58] Field of Search ..... 292/201, 341.16, DIG. 14, 292/DIG. 42, DIG. 43

[56] References Cited

U.S. PATENT DOCUMENTS

| | | | |
|---|---|---|---|
| 2,896,990 | 7/1959 | Garvey et al. | 292/341.16 X |
| 2,916,319 | 12/1959 | DuBois | 292/341.16 |
| 4,708,378 | 11/1987 | Ingenhoven | 292/201 |
| 4,739,677 | 4/1988 | Kofink et al. | 292/201 X |

FOREIGN PATENT DOCUMENTS

| | | |
|---|---|---|
| 0038226 | 10/1981 | European Pat. Off. . |
| 0143705 | 5/1985 | European Pat. Off. . |
| 2516149 | 5/1983 | France . |
| 2550266 | 2/1985 | France . |

*Primary Examiner*—Richard E. Moore

*Attorney, Agent, or Firm*—Armstrong, Nikaido, Marmelstein, Kubovcik & Murray

[57] ABSTRACT

A closing valve for interlocking a movable element and a fixed element so that both elements can be disengaged. One of the elements has a latch, while the other element has a striker which is capable of operating with the latch in order to ensure interlocking of the two elements. Either the latch or the striker is associated with a motor system for controlling the interlocking and/or the disengagement of the two elements when the clasp has been manually engaged with the latch. At an approach stage, the element which is associated with the motor can be disconnected by way of a disengaging mechanism which is triggered when the resistance for closing becomes greater than a preset level. At a final stage, the disengaging mechanism is inhibited. This invention can be used, for example, for electrically closing an automobile trunk.

19 Claims, 7 Drawing Sheets

MOTORIZED CLOSING DEVICE, PARTICULARLY FOR AN AUTOMOTIVE-VEHICLE TRUNK

The invention concerns a closing device, to interlock a movable element and a fixed element in such a way that they can be released, which has very particular application for closing an automotive-vehicle trunk.

It is known that automotive-vehicle trunk closing devices generally consist of a latch which is fixed to the stationary portion of the trunk; that is, to the automotive-vehicle body, besides a striker held by the trunk lid. Frequently the striker is U-shaped and it penetrates into the latch opening planned for it. With devices of the known type the user is obliged to slam the lid down on the trunk in order to get the striker to go far enough into the latch to engage the latch locking mechanism, thus securing the lock. To make sure the trunk is watertight all around the lid, as a rule a gasket is installed which is compressed at the moment the lid is slammed down to ensure its locking. The result is, in order for the interlock to be effective, the watertight gasket has to be crushed somewhat, which necessitates a certain compressing effort, so the user is inclined to slam the lid fairly hard to be sure it locks, which, for one thing, is not very practical for older or handicapped persons and, for another, is not to be recommended for proper maintenance of the trunk-lid hinges and watertight gaskets because, at the moment the lid is slammed shut, the percussive force exerted on the gasket is usually much more than what would be needed to simply ensure locking of the closure.

Accordingly, thought has been given to ensuring closure of a trunk like that of an automotive vehicle by means of an automatic device. Such a device simply requires, on the part of the user, effortless engagement of the striker in the latch, after which the automatic device, controlled by a motor system, relays the user's action and ensures seating of the lid on the trunk, compressing the gasket until the interlock is made. Such a closing device has the advantage of preventing any damage to the watertight gasket and lid hinges and sparing the user any effort. Unfortunately, such a device does have a drawback by reason of the fact that, if the trunk lid happens to encounter a hard obstacle, the closing force exerted by the motor system is damaging to the trunk lid and the closing device. Moreover, if the object caught between the lid and the trunk at the moment of closure is part of a human body, the user's hand or a child's hand, for example, using the motor-system operated automatic device might cause serious injury.

The purpose of this invention is to propose a closing device of the type defined above which is actuated by a motor system but which, just the same, does not have the disadvantages mentioned above. In accordance with the invention, the closing stroke, that is ensured under the effect of the motor system, is divided into an approach stage and a final stage. The approach stage begins at the moment when the clasp is engaged with the latch, and it ends at the moment when the lid is close enough to the trunk that there can be no risk of inserting any part of the human body or any hard object between the lid and the trunk. The final stage begins at the end of the approach stage, and it terminates at the moment when the watertight gasket is sufficiently compressed to accomplish the interlock. In accordance with the invention, in the course of the approach stage the motor system can be disconnected just as soon as resistance to closing exceeds a predetermined level, so it is altogether impossible for an accident to occur during that approach stage. On the other hand, in the course of the final stage disconnection of the motor system is inhibited, and all the power of the motor system is utilized to close the trunk lid. In accordance with the invention, the motor system can act either on the clasp itself or on the latch, it being understood that the action of the motor does not take effect until such time as the clasp is manually engaged in the latch by the user, which can be easily detected by a microswitch.

As a consequence, the purpose of this invention is a closing device to interlock a movable element and a fixed element so as to be releasable, one of them having a latch and the other a striker capable of cooperating with said latch to ensure interlocking of the two elements mentioned above, one of the members (either the latch or the striker) being associated with at least one motor system that controls the interlocking, and/or disengagement, of the two aforesaid elements whenever the striker has already started to engage with the latch; wherein, in an approach stage, the member (latch or clasp) associated with the motor system can be disconnected from said system because of a disengaging mechanism that is set off as soon as a resistance greater than the limit occurs in the course of the closing movement that leads to interlocking of the fixed and movable elements; whereas, in the final closing stage, said disengaging mechanism is inhibited.

In a preferred manner of embodiment, the disengaging mechanism of the closing device in accordance with the invention is put between a drive block moved by the motor system and a shunt block that controls operation of whichever of the members (latch or striker is associated with the motor system. In a preferred application the movable element holds the clasp and the fixed element has the latch. The movable element can be a bin cover connected to the bin by an articulation, in particular an automotive-vehicle (trunk) lid, and the fixed element can constitute the body of said bin, in particular the body of said automotive vehicle.

Preferably the device in accordance with the invention involves a single motor system consisting of an electric motor associated with means of transmission.

In an initial variant of the embodiment the motor system is associated with the striker.

In an initial embodiment of this first variant one can plan to have the means of transmission include a gear train driven by an electric motor, the output gear driving a worm that ensures movement of the drive block; the worm is integral with the output gear and is driven by it as it rotates, the drive block having a threaded bore and moving, in translational motion, inside a housing, just as does the shunt block associated with it.

In a second embodiment of the first variant the worm works together with a threaded bore made along the axis of the gear-train output gear, and it is kept from rotating with respect to the housing of the device, in order to move in translational motion as concerns that housing, said worm comprising a head that constitutes the drive block, at least one mobile push pin, held by the shunt block, which is pressed against the drive block by a spring, to constitute, for one thing, the mechanical connection between the drive block and the shunt block and, for another, the disengaging mechanism when the worm head gets free of the push pin due to compression of its related spring.

In the case of the first embodiment mentioned above one can advantageously plan to have the drive and shunt blocks contacting along an interface so as to allow a relative sliding effect, and to have the disengaging mechanism consist of a ball pressed by a spring to partially traverse said interface, the release effected when the ball compresses its related spring to get into a position where the interface is tangent to it under the effect of a resisting effort applied to the shunt block. Inhibition of the disengaging mechanism can be realized by interposing a key between the drive block and the shunt clock, and this keying can be provided by a sliding piston whose head is up against a guide that is integral with the case, whereas the end of the piston stem acts as a stop for a sliding push pin held against the end by a spring. The bearing surface between the push pin and the stem blends with the interface between the drive block and the shunt block in the course of the approach stage; whereas, on account of the guide shape, the push pin partially traverses said interface just as soon as the final closing stage begins.

As for the second embodiment of the first variant referred to above, the inhibiting effect of the disengaging mechanism can be obtained, at the end of the approach stage, by locking the push pin (or pins), in their support position on the drive block, by means of a locking part held by the case, said locking part being connected to the case by at least one spring and moving along with the drive and shunt blocks during the final stage. Preferably the mechanism will include at least two pivoting push pins regularly distributed around the worm axis, and then the locking part is a ring put to the right of the push-pin ends which are opposite their axes of pivot.

In a second variant of the embodiment the motor system is associated with the latch. In this instance the means of transmission can include a cable with one end fixed to a plate driven by the motor system, the other end being fixed to a slide. This slide constitutes the drive block and is subject to the effect of a recoil spring which keeps the cable taut, the motor system involving a fixed stopping device that allows the plate to rotate just once so the slide will move back and forth.

With this second variant the disengaging and release-inhibiting mechanisms can advantageously be the very same ones as planned for the first embodiment of the first variant defined above; namely, a ball-type disengaging mechanism and a key-type inhibitor. In an interesting design of this second variant the shunt block can control a lever that pivots on a fixed case pin, and said lever, bearing on a dowel which is engaged in a swiveling latch, that can lock the striker can be locked by a closing pawl, said latch being subject to a recoil spring and pivoting of the latch in the closing direction controlled by movement of said lever, the dowel able to slide with respect to the swiveling latch in order to get free of its seat on the lever, in case said lever might not have completed its return stroke due to a malfunction of the motor system, in order to permit opening the mechanism. Disengagement of the dowel in relationship to the lever can be realized with a guide ramp on which the dowel is held by a spring, said ramp being mobile, as concerns the swiveling latch, and connected to the locking pawl. The latch can consist, for one thing, of the swiveling latch maneuvered by the lever and, for another, of a swiveling counter-latch actuated by the latch on account of a gear, the latch having a forked end that receives the striker and is closed, by the counter-latch, in the closed position.

For a better understanding of the object of the invention, three modes of embodiment, represented in the attached drawing, will now be described as purely-illustrative and non-limiting examples. In the drawing.

Figure 1:
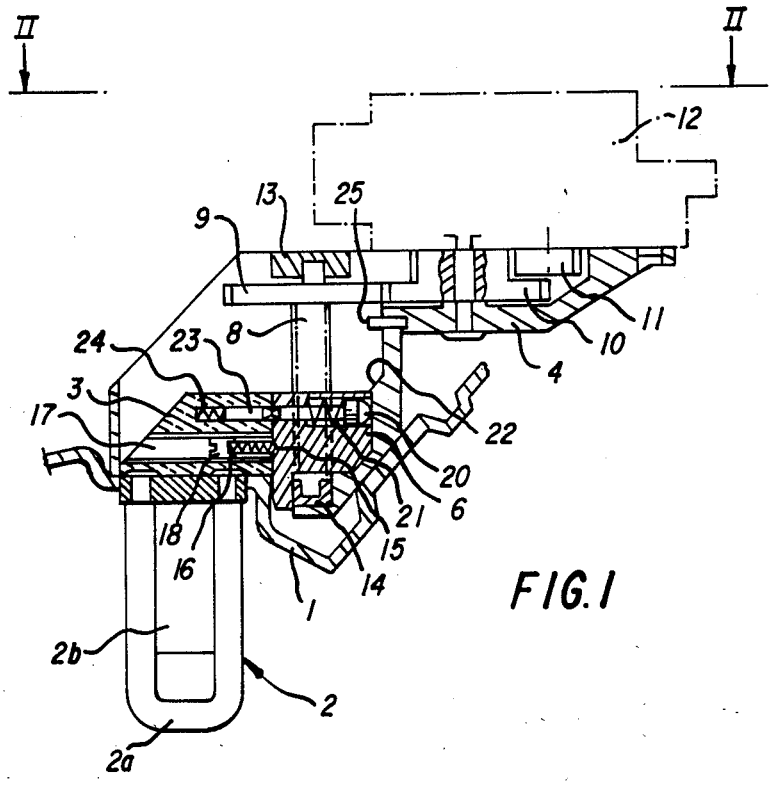
FIG. 1 represents, in partial section, a device in accordance with the first embodiment of the first variant of the invention, said section being limited to the striker, since the latch is not represented and consists of a conventional-type spring-loaded latch, the striker parts being represented in the position for opening the device; that is, at the start of the approach stage.
Figure 2:
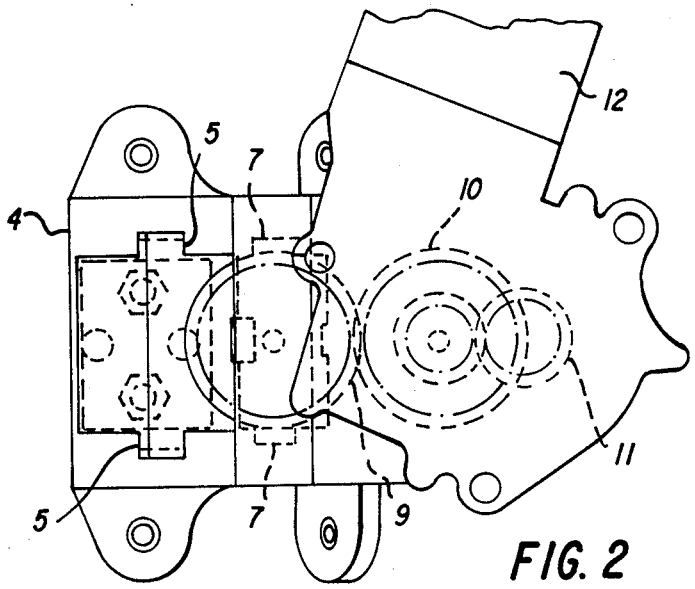
FIG. 2 represents a view along line II—II in FIG. 1.
Figure 3:
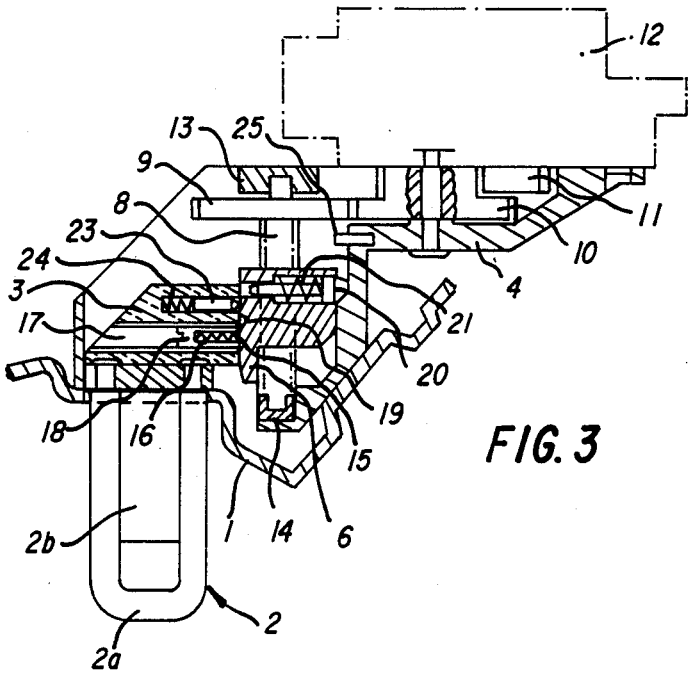
FIG. 3 is a view similar to FIG. 1 showing the striker parts after disengagement effected in the course of the approach stage.

By referring to FIGS. 1 to 4 one sees that the automotive-vehicle trunk lid has been identified as 1. Toward the inside of the trunk lid 1 has a clasp 2 in the shape of a U whose core *2a* is intended for insertion in a latch (not represented) which is carried by the stationary portion of the vehicle trunk; that is, the vehicle's body. The latch is a typical latch case that comprises an opening mechanism, the latch traversing the striker 2 in the free zone between the core 2*a* and the disc 2*b*, which occupies the upper portion of the space between the two legs of the U that the clasp forms. Via their free ends these two legs are fixed to a shunt block designated as 2 in its entirety. The shunt block 3 is put inside a case 4, which encloses the striker mechanism, and the shunt block 3 can move with translational motion, into the case 4, its guidance ensured by slides 5 parallel to the striker 2 legs. Once the lid is, for the most part, in the closing position, the striker 2 legs are practically vertical.

The shunt block 3 is associated with a drive block 6, also forced to move, with translational motion, to the inside of case 4 by gliding in slides 7 parallel to slides 5. The drive block 6 has, at its central portion, a threaded bore that cooperates with a worm 8 which is rotated right along with the output gear 9 of a gear train that comprises a double pinion 10, one of its gears meshing with gear 9 and the other one with an input pinion 11 driven by an electric motor 12 through a worm and worm wheel which are not detailed in the drawing. The 8-9-10-11 constitutes a reduction gear train that makes it possible, starting with an electric motor of fairly low power, to get considerable force for moving the drive block 6. The case 4 encloses all the elements of that gear train and accommodates, in its upper portion, the subassembly consisting of the electric motor 12, matched with its output gearing (worm and wheel). Of course, the case 4 holds the mount bearings for the various gear-train pinions, as well as the pivot bearings 13 and 14 located at both ends of the worm 8.

The drive block 6 and the shunt block 3 are in contact along a flat interface parallel to slides 5 and 7. Between those two blocks there are, on the one hand, a disengaging mechanism and, on the other, a keying device that permits inhibiting the aforementioned release. The disengaging mechanism is made up of a ball 15 which is pressed, by a spring 16, against the drive block 6, said block including a ball-joint shaped impression 19 to receive the ball 15. The ball 15 and its spring 16 are seated in a bore 17 provided inside a shunt block 3, and the compression exerted by the spring 16 on the ball 15 is controlled by means of a threaded plug 18 that is screwed part way into the bore 17. So long as the resisting force exerted on the clasp 2, and which opposes movement of the shunt block 3, is no greater than a predetermined level regulated by the plug 18, the ball 15, traversing the interface between the blocks 3 and 6, ensures the mechanical connection between both of those blocks which move, as a consequence, since they are interconnected. On the other hand, if the resisting force is in excess of the aforementioned predetermined level, the ball 15 compresses the spring 16 and goes back inside the bore 17, which frees the shunt block 3 from its interlock with the drive block 6, so we have a disengagement.

FIG. 1 represents the clasp elements in the position at the start of the approach stage; that is, the position occupied when the clasp 2 has been manually engaged in the latch case and the clasp is held that way by the latch without the trunk being closed. A microswitch put in the latch case allows spotting movement of the latch as the clasp passes through and then directs power to the motor 12. The motor 12 drives the worm 8, which causes upward movement of the drive block 6 and carries along the shunt block 3 via the disengaging mechanism 15, 16. As indicated above, this drive continues throughout the approach stage, so long as there is no resistance greater than the predetermined level. If there is, the disengaging mechanism goes into action and movement of the shunt block is halted, the situation represented in FIG. 3. Accordingly, all during the approach stage it is impossible to have a closing incident or any accident due to insertion of a human-body member between the lid and the trunk stationary wall.

Figure 4:
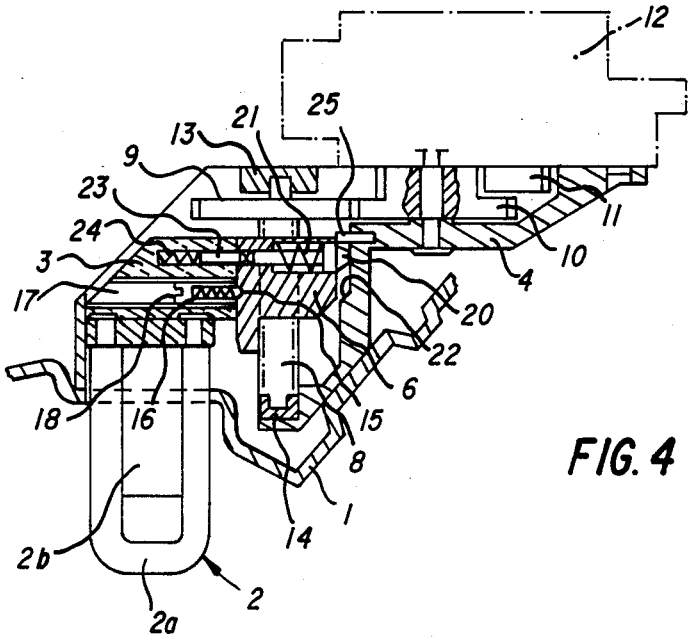
FIG. 4 is a view similar to FIG. 1 showing the clasp parts in a position corresponding to the end of the final closing stage if no release has intervened.
Figure 5:
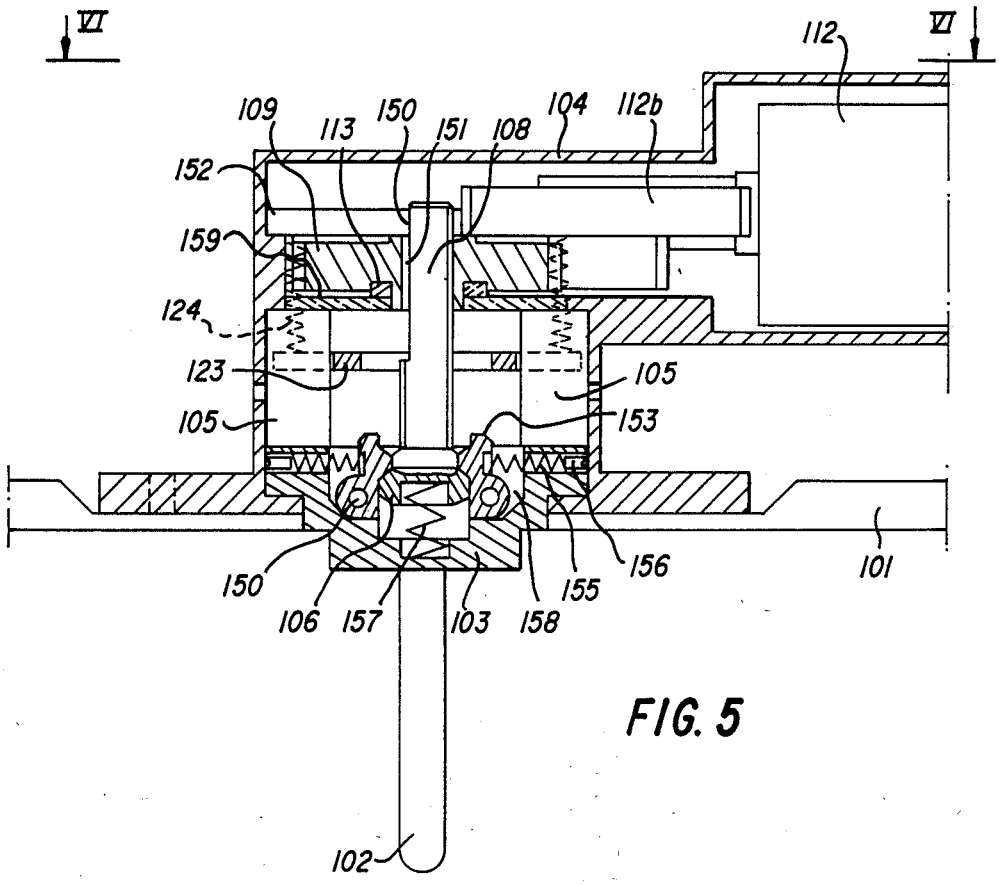
FIG. 5 represents, in diagrammatic section, a mechanism corresponding to the second embodiment of the first variant of the invention, the representation being limited to the clasp, whereas the latch is not shown but consists of a conventional-type spring-loaded latch case, the clasp parts represented in the position they occupy at opening; that is, at the start of the approach stage.
Figure 6:
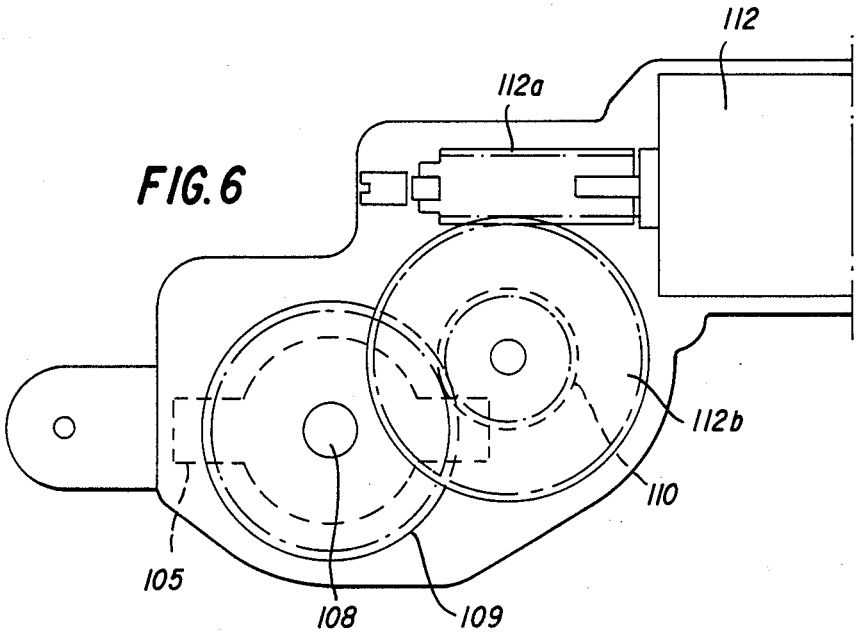
FIG. 6 represents a view along VI—VI in FIG. 5.

If there is no disengagement in the course of the approach stage, the drive block 6, along with the shunt block 3, reaches the position corresponding to the end of the approach stage. In a bore perpendicular to the interface plane between the blocks 3 and 6, the drive block encloses a sliding piston 20 that is subject to the action of a spring 21 which seats at the bottom of the bore and presses the head of the piston 20 against a guide ramp 22 held by the mechanism case 4. On the side opposite its head the piston 20 comprises a cylindrical stem that slides in a bore of smaller diameter than the one containing the piston head. The shunt block 3 also includes a bore of the same diameter as that containing the stem of the piston head 20, said bore enclosing a push pin 23 which is pressed, toward the interface between the blocks 3 and 6, by a spring 24 seated at the bottom of the bore. The push pin 23 is of the same diameter as the stem of the piston 20, so it can be accommodated in the bore for the piston 20 stem. When the blocks 3 and 6 are locked together by the ball 15, the push pin 23 lines up exactly with the extension of the piston 20 stem. Throughout the approach stage the guide ramp 22 keeps the piston 20 head in a position such that the push-pin 23 bearing plane on the piston 20 stem blends with the plane of the interface between the blocks 3 and 6. When the approach stage is over, the guide ramp 22 allows the piston 20 to move into its bore under the effect of the spring 21, so the push pin 23, acted on by the spring 24, goes into the bore containing the piston 20 stem. Thus the push pin 23 constitutes a keying device between the blocks 3 and 6, which inhibits the disengaging mechanism 15 and 16. As a result, during the final stage, which begins at the moment the ramp allows the piston 20 to move, the shunt block 3 is obliged to follow the translational motion of the drive block 6, so the full power of the motor 12 is employed to pull on the striker 2, which brings the trunk lid closer to the vehicle body, since we reduce the distance between the lid 1 and the fixed latch case held by the body. For that reason, the full power of the motor 12 permits compressing the trunk watertight gaskets until we get to the end of the final stage, as represented in FIG. 4. In that case, the drive block comes to rest on a stop 25 which, via a microswitch, controls power cutoff from the motor 12.

Thus it is evident that we have, in that manner, divided the closing stroke of the device in accordance with the invention into an approach stage, where the automatic drive can be disengaged, and a final stage, where the automatic drive cannot be disengaged and allows for ensuring, with all the power required, compression of the trunk watertight gaskets. Opening of the trunk is accomplished by powering the motor 12 in the opposite direction, which causes inverse movement of the striker 2 with respect to the lid, and after that there is nothing else to do but to work the latch in the conventional way.

In a special form of embodiment the striker 2 actuating time for opening or closing amounts to 2.5 seconds; the motor 12 is powered by 9-volt direct current, and the closing effort exerted on the striker 2 is 50 daN. The total closing stroke is 20 mm long and the approach stage 10 mm; disengagement is effected in the course of the approach stage if the resisting force is greater than 16 daN.

A second form of embodying the first variant of the invention is represented in FIGS. 5 to 10. With that embodiment those elements similar to the ones that have been described for the first embodiment bear the same reference numbers increased by 100. In that variant an electric motor 112 drives a striker 102 in order to move it with regard to lid 101 for an automotive-vehicle trunk. The striker 102 is U-shaped, as in the first form of embodiment, and it works in conjunction with a conventional-type latch case in the same manner as described for the embodiment in FIGS. 1 to 4. When the lever core of the striker 102 is manually engaged in the latch case, a microswitch controls powering of the motor 112 to cause the striker to move upward and, as a consequence, movement of the mobile lid toward the stationary portion of the trunk. Just as before, the closing stroke is divided into two portions, an approach stage in which the clasp 102 drive can be disengaged, and a final stage in which the disengaging mechanism is inhibited.

By means of a system (worm 112*a*/wheel 112*b*) the motor 112 drives a gear train consisting of a pinion 110 that drives the output gear of the gear train. The worm wheel 112*b* and the pinion 110 are keyed to the same shaft. The output gear 109 rests on a bearing 113 carried by the mechanism's case 104. Along its axis the output gear 109 includes a threaded bore 151 that works with a worm 108 comprising flat 150. The worm 108 slides in an orifice, whose shape corresponds to its cross section, said orifice being made in a plate 152 carried by the case 104 and located above the output gear 109. When that gear 109 is made to turn, the position of its median plane is fixed with respect to the case 104; since the worm 108 is kept from turning by cooperation of its flat 150 with the corresponding rim of the orifice made in the plate 152, rotation of the gear 109 produces translational movement of the worm 108 in relationship to the case 104.

At the lower portion of the worm 108 a head 106 has been provided that constitutes the drive block for the device. At its lower portion the head 106 comprises an O ring that cooperates with two mobile push pins 153 held by a shunt block 103 to which the clasp 102 is fastened. The shunt block 103 can move in translational motion into the case 104 because of two slides 105 which are parallel to the worm 108 axis. Each of the push pins 153 can swivel on a pin 154 held by the shunt block 103, and they are pushed symmetrically to either side of the worm head, which constitutes the drive device 106, by springs 155. Each push pin 153 has a boss opposite the drive device 106. When the drive block 106 and the shunt block 103 are in their low position; that is, at the start of the approach stage, the two push pins 153 have their boss resting on the worm 108 head just above the O ring that said head holds at its lower portion. The result is that, if we move the worm 108 upward in FIG. 5, the push pins 153 ensure transmitting of the translational motion upwards by hooking on above the rim that constitutes the O ring. Thus the worm 108 can produce the upwards translational movement of the shunt block 103 and clasp 102.

Figure 7:
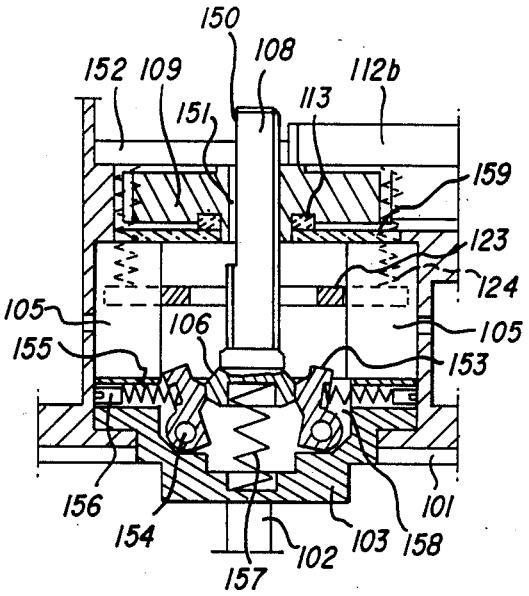
FIG. 7 represents the disengaging mechanism for the FIG. 5 embodiment in a position corresponding to disengagement at the start of the approach stage.

This drive is maintained just to the extent that the resisting force exerted on the clasp 102 is no greater than a predetermined level; beyond that level the force exerted by the drive block 106 on the push pin 153 bosses is sufficient to cause compression of the springs 155 and, consequently, swiveling of the push pins 153 on their axes 154, which permits disengagement of the drive block 106 from the shunt block 103. That situation is shown in FIG. 7 and corresponds to disengagement of the drive system from the clasp 102 in the event the force resisting closure is more than the fixed level. That level is regulated by precompressing the springs 155, which precompression is obtained via the threaded plugs 156 that can be screwed part way into the bores made in the shunt block 103 that contains the springs 155.

Figure 10:
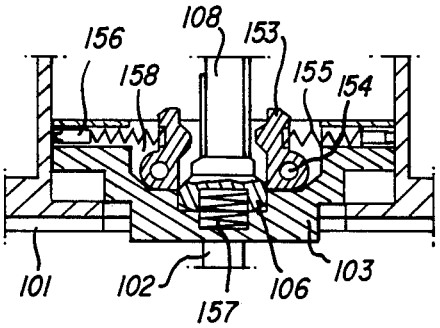
FIG. 10 represents a section view of the disengaging mechanism for the embodiment in FIGS. 5 to 9 when the user slams the lid and its striker into engagement with the latch at the start of the approach stage.

A spring 157 is put between the shunt block 103 and the drive block 106 so that, if the user slams down the lid in order to engage the striker 102 in the latch case held by the vehicle body, the spring 157 absorbs the excess energy by compressing and without any risk of shock at the end of the worm 108, which could damage the worm threads. That compression of the spring 157 is represented in FIG. 10, and it should be noted that the spring 157 also provides shock protection for the striker 102 and the latch of the associated lock.

The general form of the shunt block 103 is a cylindrical shape, except for the two diametrically-opposed tabs that go into the slides 105. The push pins 153 are arranged in a central bore 158 provided in the upper portion of this shunt block 103. The shunt block 103 moves, inside the case 104, into a cylindrical recess in whose median zone there is a cylindrical ring 123 connected to the case 104 by coil springs 124 whose axis is virtually parallel to the worm 108 axis. The springs 124 are regularly distributed on the ring 123, so the ring 123 is located to the right of the shunt block 103 and can, by compression of the springs 124, move into the cylindrical recess provided for passage of the shunt block 103. The control opening in the ring 123 is of such dimensions as to permit the ring to position itself around the push pin 153 heads.

Figure 8:
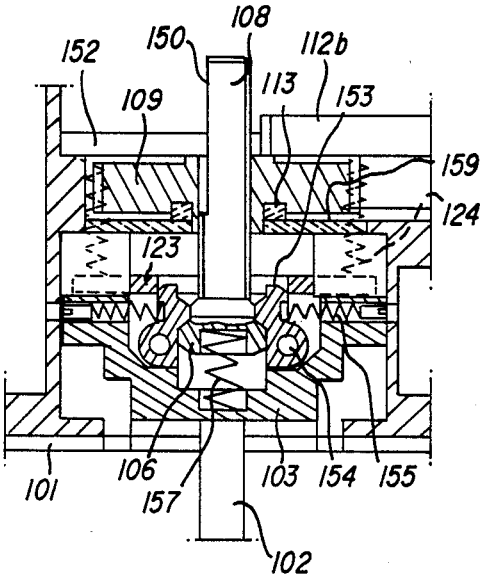
FIG. 8 represents a view similar to FIG. 7 when the approach stage occurs without disengagement and the disengaging mechanism is inhibited at the start of the final stage.
Figure 9:
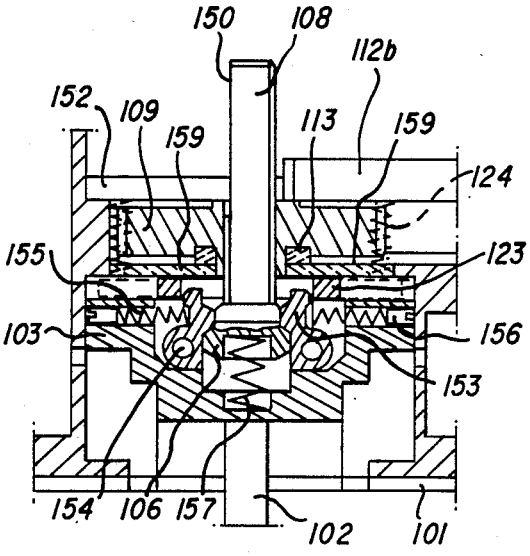
FIG. 9 represents a view similar to FIG. 7 when the parts have reached the end of the final stage without any disengagement occurring.

When the motor 112 has caused the shunt block 103 to move all through the approach stage, which is represented in FIG. 8, the push pin 153 heads engage in the central opening of the ring 123 which, thus, acts as a locking part and keeps the push pins from separating. Hence the disengaging mechanism, constituted by the push pins 153, is inhibited by the ring 123, and any translational movement of the worm 108 is necessarily transmitted to the shunt block 103. Thus the final closing stage is started, which continues until such time as the ring 123 comes to rest against the case block 159 that holds the bearing 113 for gear 109, the position represented in FIG. 9. The springs 124 are, then, compressed, and the fact that the ring 123 bears on the plate 159, which serves as a stop, triggers a microswitch that cuts off power to the motor 112.

Accordingly, we see that there, too, just as for the embodiment in FIGS. 1 to 4, the device in accordance with the invention permits, in the course of an approach stage, having a releasable drive for the clasp 102 and, in a final stage, transmitting the full power of the motor 112 to the clasp 102 in order to ensure closing of the trunk.

Described now is a design corresponding to the second variant of the invention and represented in FIGS. 11 to 17. In that variant the motor that controls the closing device in accordance with the invention is associated not with the clasp, as in the two preceding forms of embodiment, but with the latch. Thus it is that the clasp carried by the trunk lid is a simple U fastened to the lower portion of the lid and moved manually into an engaged position inside of the latch. For that embodiment the elements that are similar to those for embodiment in FIGS. 1 to 4 are designated by the same reference numbers increased by 200.

The motor system associated with the latch is an electric motor 212 connected, by way of worm-and-wheel reduction gearing (not represented), to a plate 50 from whose periphery there projects a mounting dowel 251. The plate 250 is located inside the housing 253 that contains the reducer associated with the motor 212, and it is surmounted by a protective plate 252. The mounting dowel 251 moves circularly around the shaft of plate 250; a duct 254 is made in the housing 253 to allow passage to the outside of a cable 255 whose end is hooked on the mounting dowel 251, the duct 254 being covered over the plate 252. The motor 212 is associated with a stationary stopping device (not represented) that allows the plate 250 to rotate just one turn and cuts off power to the motor just as soon as the plate 250 has made a 360° turn. Thus, for each turn of the plate 250 the cable 255 moves back and forth a distance equal to the diameter of the plate 250.

Figure 13:
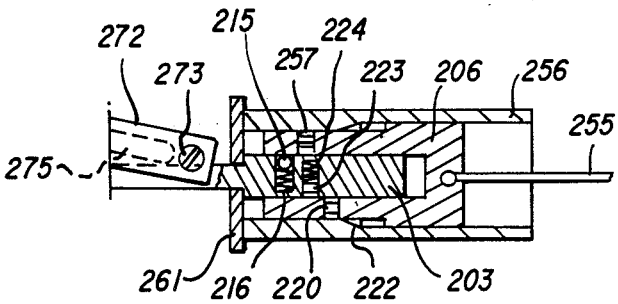
FIG. 13 represents the disengaging mechanism for the variant in FIG. 11 when disengagement takes place.

The cable 255 is connected to a drive device 206 which is a slide capable of moving inside a sleeve 256. A bore has been made along the axis of the slide 206 inside which a shunt block 203 is engaged. The mechanical interlock between the shunt block 203 and the drive block 206 is ensured by a ball 215 put at the interface between the blocks 203 and 206. Once the shunt block 203 is completely engaged inside the drive block 206, the ball 215, which is pressed by a spring 216 installed in a bore of the shunt block 203, is positioned opposite a bore of corresponding diameter made in the wall of the drive block 206, which demarcates the seat for the shunt block 203. This bore encloses a cross member 257 that keeps the ball 215 in a position where it is engaged, over less than half its volume, inside the bore where the cross-member 257 is located. The ball 215 constitutes a mechanical-connection system between the blocks 203 and 206, yet it is a releasable system since, if the resisting effort exerted on the shunt block 203 exceeds a predetermined level, the spring 216 compresses and allows the ball 215 to go back all the way inside the bore that accommodates the spring 216, which releases the interlock between the shunt block 203 and the drive block 206, and that status of the device is shown in FIG. 13.

Inside the sleeve 256 a guide ramp 222 has been provided. This guide ramp works together with a push pin 220, installed in a bore made in the wall of the shunt block 206, that demarcates the accommodation for the shunt block 203. Once that shunt block 203 is completely engaged inside the drive block 206, the push pin 220 is positioned opposite a push pin 223 of the same diameter. The push pin 223 is put inside a bore provided for that purpose within the shunt block 203, push pin 223 being pressed by a spring 224 toward the interface between the blocks 203 and 206. When the device is at the start of the approach stage, the slide, which constitutes the drive block 206, is up against the plate 261, and that closes off the sleeve 256 at the end opposite that one via which the cable 255 penetrates. In that position the guide ramp 222 keeps the bearing surface of the push pins 220 and 223 coincident with the interface between the blocks 203 and 204. If the slide, which constitutes the drive block 206, moves inside the sleeve 256, the push pin 220 reaches a point on the ramp 22 where it is permitted to move inside its bore under the pressure of spring 224. In that case, the push pin 223 goes through the interface between the blocks 203 and 206, which constitutes a keying that serves to inhibit the disengaging mechanism 215, 216, the position represented in FIG. 14. The moment that the ramp 222 allows the push pin 220 to move corresponds to the end of the approach stage and the start of the final stage.

The shunt block 203 extends via a stem **203*a* around which there is a coil spring 262 that is compressed between the head of said stem 203*a* and the closing plate 261 for the sleeve 256. That spring 262 keeps cable 255 taut all the time. The stem 203*a*** controls the latch of the device in accordance with this variant of the invention.

Figures 11, 12:
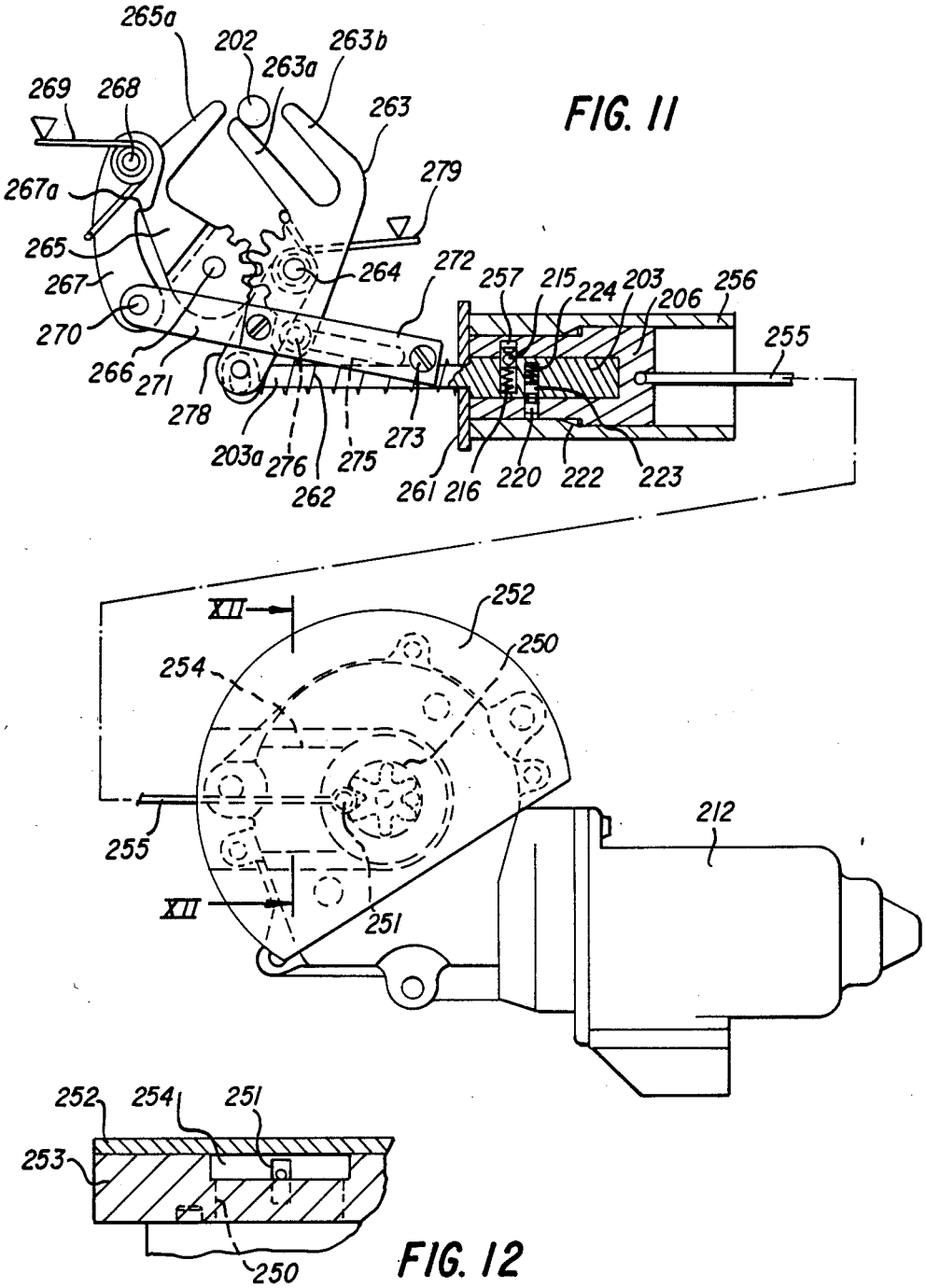
FIG. 11 represents diagrammatically a device in accordance with the second variant of the invention, the motor system being associated with the latch, the striker being a simple U integral with the lid of an automotive-vehicle trunk, the latch parts being represented in the position that corresponds to the start of the approach stage.
FIG. 12 represents a cross section along XII—XII in FIG. 11.
Figure 14:
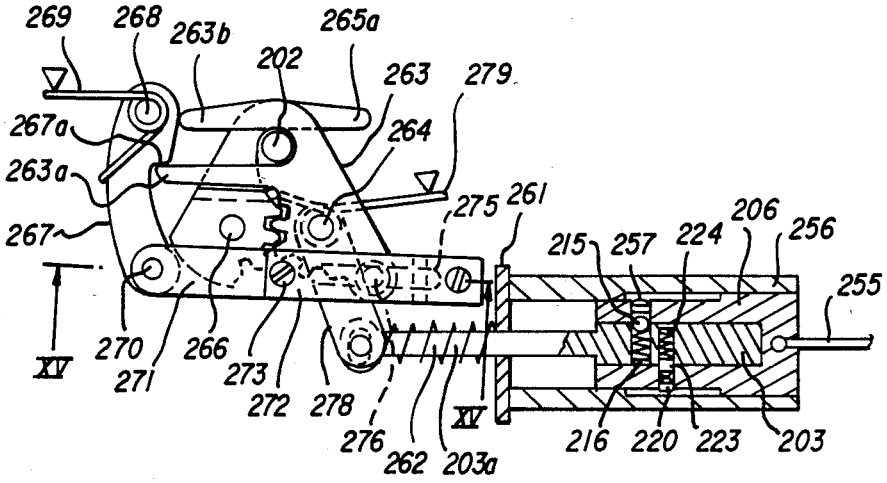
FIG. 14 represents the latch for the embodiment in FIG. 11 when there is no disengagement and the final stage is in progress.
Figure 15:
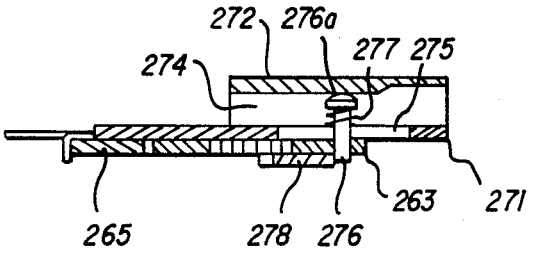
FIG. 15 represents a section along XV—XV in FIG. 14.
Figure 16:
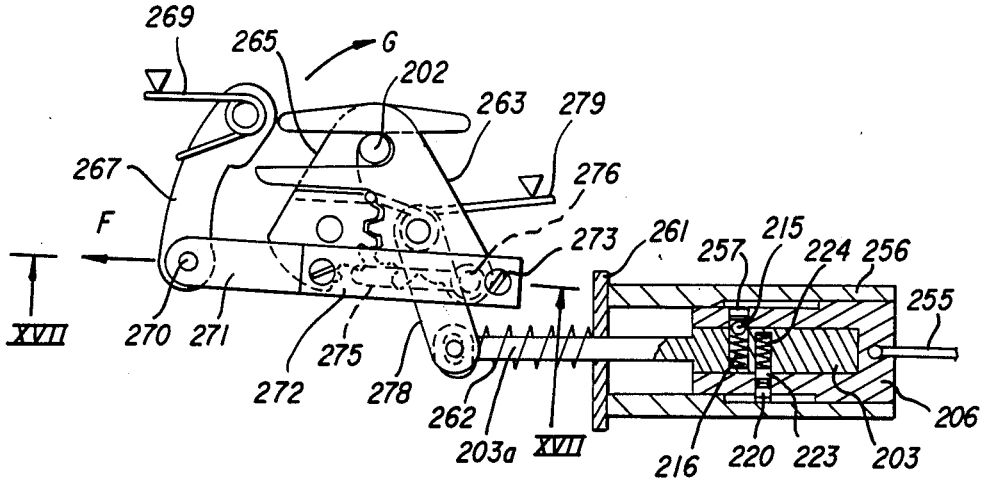
FIG. 16 represents the latch parts for the variant in FIG. 11 when the latch is in the closed position and, following a malfunction, the drive block has not returned to the initial position and the user has acted manually to release the closure.

The latch is represented in three different positions in FIGS. 11, 14 and 16, but just the mechanical elements are shown in the drawing, the latch-case housing not being included for the sake of clarity. With manual engagement the clasp 202, held by the trunk lid, comes to rest on the lower leg **263*a* of a fork-shaped latch that is designated by 263 in its entirety. The latch 263 is capable of swiveling on a fixed pin 264, and at the end opposite its axis of pivot it has a fork that consists of a lower leg 263*a* and an upper leg 263*b*, the leg 263*a* being longer than the leg 263*b*. On a portion of its rim encircling the pin 264 the latch 263 has a gear-tooth shaped recess which cooperates with a corresponding recess made in a counter-latch 265. The counter-latch 265 swivels on a fixed pin 266 and, in the zone opposite its axis of pivot, it has a single tooth 265*a*. When the clasp 202 is manually positioned up against the leg 263*a* of the latch 263 (see FIG. 11), said latch is obliged to swivel slightly in its pin 264, which controls a microswitch that feeds power to the motor 212**.

As will be described in detail hereunder, the motor 212 will cause swiveling of the latch 263 which, by way of its gear teeth, causes the counter-latch 265 to swivel in the opposite direction, so the clasp 202 core manages to position itself at the base of the fork **263*a*, 263*b* and is locked there by the single tooth 265*a* of the counter-latch 265, the position shown in FIGS. 14 and 16**.

When the latch 263 and the counter-latch 265 are brought into the closing position that way, the tooth **263*a* forms a pawl-and-ratchet mechanism under the peg 267*a* of a dog 267 capable of swiveling on a fixed pin 268. The dog 267 is subject to the action of a recoil spring 269 and holds, at the end opposite its axis of pivot, a pin 270 on which a link 271 articulates. At its end opposite the pin 270 the link 271 carries a guide ramp 272 that is fastened on it by screws 273 and which demarcates, between it and the link 271, a tunnel 274. To the right of the tunnel 274 link 271 has an oblong recess 275 that is traversed by a dowel 276 whose head 276*a* is kept against the guide ramp 272 by a spring 277 inserted between said head 276*a* and the link 271. Via a bore the dowel 276 goes through the latch 263 and projects from the side of the latch opposite the link 271. A lever 278, whose opposite end pivots on pin 264, articulates at the end of the stem 203*a*. The lever 278 is placed along the face of the latch 263 opposite the link 271. The lever 278 comes up against the projecting end of the dowel 276, and it is situated on the side of that dowel opposite the sleeve 256**.

When the drive block 206 is pulled by the cable 255 to the right in FIG. 11, the lever 278 swivels on the pin 264 and, via the dowel 276, causes the latch 263 to rotate in the closing direction, the position represented in FIG. 14. Once closing is realized, the dog 267 keeps the latch 263 and the counter-latch 265 in the closing position. Closure is effected with a half-turn rotation of the plate 250, and, with a further half-turn rotation, the cable 255, which is kept taut by spring 252, lets the drive block 206 recover its initial position; that is, the one shown in FIG. 11. In that movement the lever 278 also return to its initial position, but the latch stays in the closing position on account of the dog 267. To trigger opening, one needs just to pull pin 270 to the left by hand in order to release the peg 267*a*. In that case, under the force of its recoil spring 279 the latch 263 returns to the opening position by rotating on its pin 264, which causes simultaneous rotation in the opposite direction of the counter-latch 265. The dowel 276 goes back against the lever 278, so the device is restored to the initial position.

It is possible to have a malfunction of the electric control device. If that malfunction occurs ahead of the closing position, closure can be accomplished manually, in which case the dowel 276 slides in the oblong opening 275, and the user would, of course, have to provide all the closing effort on the clasp 202 in order to crush the watertight gaskets sufficiently for the leg 263*a* to hook under the peg 267*a*.

Figure 17:
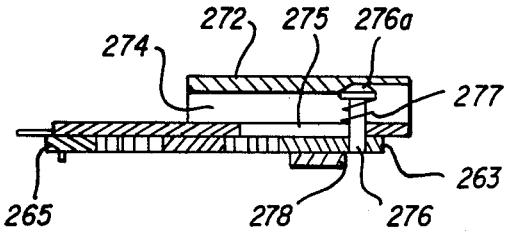
FIG. 17 is a section along XVII—XVII in FIG. 16.

If, on the other hand, the malfunction happens after the closure is realized, due to action of the motor 212, yet before the lever 278 has gone back to its initial position; that is to say, if the malfunction is in the course of the rear return movement of the cable 265 and the drive device 206, then opening can be accomplished by exerting a force F on the pin 270, as indicated in FIG. 16. For one thing, by doing so we release tooth 263*a* from the lock made by dog 267; for another, the link 271 is made to slide with regard to the dowel 276 which is locked by the lever 278 whose return has not been effected. In that movement the guide ramp moves, in relationship to the dowel 276, until said dowel, pressed by the spring 277, moves in the bore, via which it goes through the latch 263, until the projecting portion on which the lever 278 was resting disappears altogether. The latch 263 is free to swivel on its pin 264 under the effect of its recoil spring 279. That disengaged position of the dowel is represented in FIG. 17, whereas FIG. 16 shows the device in that instance where the lever 278 is locked at the beginning of its return stroke and where the user's acting on pin 270 with force F moves the dowel into the position shown in FIG. 17, opening of the latch not having yet occurred, though it can be accomplished in accordance with arrow C.

We see that this second variant of the invention permits controlling the latch by means of an electric motor which can be disconnected during the approach stage, on account of the disengaging mechanism 215–216, but it is not disconnectable during the final stage because of the keying device 220-223-224 which inhibits the disengaging mechanism.

It is understood that the forms of embodiment described above are in no way limiting and may entail any desirable modifications without straying from the scope of the invention.

We claim:

1. A closing device, comprising:

a movable element and a fixed element which can be interlocked by said closing device, wherein said movable and fixed elements are disengageable;

a latch and a striker, cooperating with each other, joined to said movable and fixed elements for ensuring interlocking of said movable and fixed elements;

at least one motor means associated with at least one of said latch and said striker for ensuring at least one of interlocking and disengagement of said movable and fixed elements;

a disengaging means for disconnecting at least one of said associated latch and striker from said motor means during an approach stage of said closing device, wherein said disengaging means is triggered when resistance force applied to at least one of said associated latch and striker is greater than a preset level so as to maintain interlocking of said movable and fixed elements, and wherein during a final closing stage of said closing device, said disengaging means is inhibited.

2. A device in accordance with claim 1, further comprising a drive block which is moved by the motor means, and a shunt block which controls operation of at least one of said latch and striker, said disengaging means being interposed therebetween.

3. A device, in accordance with claim 1 or 2, wherein the movable element (1,101) carries the clasp (2, 102) and the fixed element holds the latch.

4. Device, in accordance with claims 1 to 2, wherein the movable element (1,101) is a chest cover, which is connected to said chest by an articulation, in particular an automotive vehicle trunk lid, and the fixed element consists of the body of said chest, in particular the body of said automotive vehicle.

5. Device, in accordance with claims 1 to 2, wherein it involves a single motor system consisting of an electric motor (12,112,212) associated with means of transmission.

6. Device, in accordance with claim 5, wherein the motor system (12,112) is associated with the clasp.

7. Device, in accordance with claim 2 considered simultaneously, wherein the means of transmission comprise a gear train (9,10,11; 109,110) driven by the electric motor (12; 112), the output gear (9,109) of said train driving a worm (8,108), which ensures movement of the drive block (6,106).

8. Device, in accordance with claim 7, wherein the worm (8) is integral with the output gear (9) and made to rotate along with it, the drive block (6) entailing a threaded bore and moving, via translational motion, into a case (4), the same as the shunt block (3) that is associated with it.

9. Device, in accordance with claim 7, wherein the worm (108) works together with the threaded bore made in the output gear (109) axis and is kept from rotating, with respect to the housing (101) for the device, said worm (108) comprising a head (106) that constitutes the drive block, at least one mobile push pin (153) carried by the shunt block (103) coming to rest on the drive block (106) under the action of a spring (155) to constitute, on the one hand, the mechanical connection between the drive block (106) and the shunt block (103) and, on the other, the disengaging mechanism when the head of the worm (108) gets free of the push pin (or pins) (153) due to compression of the associated spring (155).

10. Device, in accordance with claim 9, wherein inhibiting of the disengaging mechanism (153,154) is obtained, at the end of the approach stage, by locking of the push pin (or pins) (153), in their bearing position on the drive block (106), by means of a locking part (123) carried by the housing (101), said locking part connected to the housing by at least one spring (124) and moving along with the drive (108) and shunt (103) blocks in the course of the final stage.

11. Device, in accordance with claim 10, wherein it involves at least two swiveling push pins (153), arranged regularly around the axis of the worm (108); and wherein the locking part is a ring (123) placed to the right of the pin ends that are opposite their axes of pivot (154).

12. Device, in accordance with claim 5, wherein the motor system (212) is associated with the latch.

13. Device, in accordance with claim 12, wherein the means of transmission comprise a cable (255), one of whose ends is fastened to a plate (250) driven by the motor system (212) and the other end fixed to a slide (206). The slide constitutes the drive block and is subject to the action of a recoil spring (262) that keeps the cable under tension, the motor system including a stationary stopping device that allows a plate (250) to rotate just one turn in order to cause the side (206) to move back and forth.

14. Device, in accordance with claim 8, wherein the drive blocks (6,206) and shunt blocks (3,203) are in contact along an interface that permits relative sliding, and the disengaging device consists of a ball (15,215) pressed by a spring (16,216) to partially traverse the interface, the disengagement being accomplished when the ball (15,215) compresses its related spring (16,216) to get to a position where the interface is tangent to it under the effect of resisting effort applied to the shunt block (3,203).

15. Device, in accordance with claim 8, wherein inhibiting of the disengaging mechanism results from keying interposed between the drive block (6,206) and the shunt block (3,203).

16. Device, in accordance with claim 15, wherein the keying is obtained with a sliding piston (20,220) whose head bears on a guide (22,222) integral with the housing, whereas the end of the stem of the piston (20,220) acts as a stop for a sliding push pin (23,223) kept against it by a spring (24,224), the bearing surface between the push pin (23,223) and the stem blending with the interface between the drive block (6,206) and the shunt block (3,203) during the approach stage; whereas, by virtue of the shape of the guide (22,222), the push pin (23,223) passes part way through the aforementioned interface as soon as the final stage of closing begins.

17. Device, in accordance with claims 14, 15 or 16, wherein the shunt block (203) controls a lever (278) that swivels on a fixed pin (264) of the housing, said lever (278) bearing on a dowel (276) engaged in a swiveling latch (263) which can lock the clasp (202) and be locked by a dog (267) in the closing position, said latch (263) being subject to a recoil spring (279) and the movement of the lever (278) controlling the latch (263) swivel in the direction of closing. The dowel (276) can slide, in relationship to the swiveling latch (263), in order to be free from resting on the lever (278) in case said lever has not completed its return stroke by reason of a malfunction in the motor system (212).

18. Device, in accordance with claim 7, wherein disengagement of the dowel (276), with respect to the lever (278), is realized via a guide ramp (272), against which the dowel (276) is held by a spring (277), said ramp being movable with regard to the swiveling latch (263), and it is also connected to the locking dog (267).

19. Device, in accordance with claim 18, wherein the latch member is comprised, for one thing, of the swiveling latch (263) maneuvered by the lever (278) and, for another, by a swiveling counter-latch (265) actuated by the latch (263) proper by virtue of a gear, the latch (263) having a forked end that receives the clasp (202) and is closed by the counter-latch (265) in the closing position.

* * * * *